United States Patent [19]

Engström

[11] Patent Number: 5,016,374

[45] Date of Patent: May 21, 1991

[54] BUILDABLE DEVICE INCLUDING MODULAR FRAME ASSEMBLY

[75] Inventor: Carl-Otto Engström, Stockholm, Sweden

[73] Assignee: Ahlberg & Co. AB, Stockholm, Sweden

[21] Appl. No.: 399,510

[22] PCT Filed: Apr. 8, 1988

[86] PCT No.: PCT/SE88/00171

§ 371 Date: Sep. 13, 1989

§ 102(e) Date: Sep. 13, 1989

[87] PCT Pub. No.: WO88/08186

PCT Pub. Date: Oct. 20, 1988

[30] Foreign Application Priority Data

Apr. 10, 1987 [SE] Sweden ..... 8701511

[51] Int. Cl.[5] ..... G09F 7/00

[52] U.S. Cl. ..... 40/605; 160/135; 52/239; 52/715; 24/458

[58] Field of Search ..... 40/605; 160/135, 351; 52/239, 712–715, 677; 24/295, 294, 458; 16/385, 225, 227; 734/428, 430

[56] References Cited

U.S. PATENT DOCUMENTS

| | | | |
|---|---|---|---|
| Re. 28,672 | 1/1976 | Wakeman | 16/227 |
| 1,480,606 | 1/1924 | Fetters | 40/605 |
| 3,154,870 | 11/1964 | Hopp et al. | 40/605 |
| 3,403,720 | 10/1968 | Ahleen | 160/231.2 |
| 3,514,886 | 6/1968 | Drackard | 40/155 |
| 3,527,283 | 9/1968 | Butler et al. | 16/225 |
| 3,695,330 | 10/1972 | Hasbrouck | 160/351 |
| 3,751,760 | 8/1973 | Wakeman | 16/227 |
| 3,913,656 | 10/1975 | Guyer | 16/227 |
| 4,089,467 | 5/1978 | Markowicki | 16/225 |
| 4,147,198 | 4/1979 | Ytter | 160/229.1 |
| 4,453,471 | 6/1984 | Harrington et al. | 24/458 |
| 4,658,472 | 4/1987 | Grenier | 16/225 |
| 4,722,146 | 2/1988 | Kemeny | 40/605 |

FOREIGN PATENT DOCUMENTS

| | | | |
|---|---|---|---|
| 1249410 | 1/1989 | Canada | 52/239 |
| 2495682 | 6/1982 | France | 16/225 |
| 2189290 | 10/1987 | United Kingdom | 16/227 |

*Primary Examiner*—Kenneth J. Dorner
*Assistant Examiner*—James M. Gardner
*Attorney, Agent, or Firm*—Nixon & Vanderhye

[57] ABSTRACT

The present invention relates to a device for receiving essentially planar products, preferably graphic products, which includes two or several frames. Each frame can receive two such products and is formed by four frame members with a longitudinal first flange and a second flange located at one longitudinal narrow side of the first flange. A product inserted into the frame engages the first flanges of the four frame members with its one side and abuts the other flanges with its side edges. The frames are sidewardly hingedly interconnected by means of band-shaped hinges, these band-shaped hinges being designed with two ends and provided with a resilient folding or bending at each end, which is arranged to be received and/or restrained between two opposing walls defining a space in a respective frame member.

11 Claims, 4 Drawing Sheets

BUILDABLE DEVICE INCLUDING MODULAR FRAME ASSEMBLY

This invention relates to a buildable device for receiving essentially planar, preferably graphic products in accordance to what is stated in the introductory clause of claim 1.

The device can be charged with different kinds of pictures, advertising text, information data or similar being suitable for various occasions as trade fairs, exhibitions, advertising displays and the like. It can also be used for screening and subdividing office rooms and the like, in which case, for instance, a sound absorbing board can be mounted in the device. The device is furthermore simple to mount and dismount, i.e. solely by means of only a low number of simple manipulations. The device can be carried by one person in a mounted condition.

Stands for receiving pictures are known which for instance include eight frames arranged in two superposed rows with four frames in each row. The frames are sidewardly interconnected by means of hinges in such a way that they can be folded in both directions along a vertical axis between the frames so that they engage each other with their largest sides, these hinges being known per se. The outermost frame at one end of the upper row is hingedly connected with the outermost frame in the corresponding end of the lower row. The other frames in the upper row are releasably connected to the corresponding frame in the lower row by means of snap-action type locks. When the picture stand is to be folded, the interconnected rows are first folded as a unit. The snap-action locks are then disconnected and the folded upper row is folded downwards, towards the folded lower row. Each frame according to the prior art consists of four profiled mouldings arranged in a rectangle, each moulding having two grooves being arranged parallel in respect to each other with a medial flange extending between the grooves giving the frame rigidity. The upper profiled mouldings of the frames in the upper row and the lower profiled mouldings of the frames in the lower row can be opened in a way that two pictures can be inserted into the circumferential grooves formed by the three remaining profiled mouldings in the frame.

U.S. Pat. No. 1,282,685 discloses a foldable screen for screening or subdividing for instance a room. The screen includes a number of sections in an upper and a lower row, a main section in the upper row being hingedly connected to a main section in the lower row and the sections in the upper row being hingedly interconnected, as is the case with the sections in the lower row.

U.S. Pat. No. Re. 30,777, Oct. 20, 1981 discloses a development of the foldable picture stand according to the above mentioned American patent specification having eight frames arranged in an upper and in a lower row. The frames are hingedly interconnected by means of hinges in such a way that the stand can be folded. In each frame, pictures can be inserted into grooves in the mouldings forming the frames.

U.S. Pat. No. 3,514,886 and 3,882,974 both disclose frames for the insertion of pictures. The frames are constructed of profiled mouldings having longitudinal grooves facing the center of the frame. When a picture is to be applied in the frame, one of the four profiled mouldings are removed and the picture is inserted into the frame.

There are several disadvantages associated with the above-mentioned prior art picture stands.

Firstly, there are problems when they are to be charged, since the pictures, for practical reasons, only can be inserted into the grooves in the profiled mouldings of the frames when the picture stand is in its mounted condition. Because of this it is difficult to ensure that all pictures are in their right place and are facing the right way. In addition to this, if the places of some pictures are to be changed or if a picture is to be changed, the entire screen must be mounted before this can be done.

Secondly, the joints between the different pictures in the picture stand are too wide. This is on one hand due to the space between the frames, and on the other hand due to the fact that the flanges of the grooves, which hold the pictures, project far out over the picture. This gives an improper impression, particularly when two or more pictures in conjunction are to form a whole.

Thirdly, the hinges used today give a very ugly visual impression since they protrude out in front of the frames with their articulated joint.

Fourthly, these hinges are so wide that they cause a large space between the frames.

Fiftly, the existing picture stands are not buildable to a sufficient extent. Since the hinges used today are fixedly mounted in the frame constructions, a considerably amount of work is necessary, if, for instance, additional frames are to be attached to the picture stand or if some frames are to be removed therefrom.

Sixtly, the prior art picture stands are too complicated, especially in view of the charging with pictures, to be usable by banks, insurance companies or similar in windows or in similar advertising locations.

Seventhly, there is no simple way of attaching brackets for shelves in the present picture stands.

The object of the present invention therefore is to create a device for the receiving of essentially planar pictures and similar which is simple to mount and dismount. It should further be possible to charge the device with pictures in its mounted condition. A further object is to create a device which has a considerably smaller distance between the pictures in the mounted condition. Still another object is that it should be possible to complement the device with additional frames, top frames and bracketed shelves and to provide the device with light-reflecting screens in a simple manner. Still another object is to create a device which in its folded condition forms a unit being yet more compact than prior art picture stands and which easily can be carried by one person. Another object is that the inserted picture shall conceal the supporting frame work of the frame as well as the attachment point of the hinges. These objects are achieved with a device having the features given in the claims.

Some advantageous embodiments of the invention will be more closely described below with reference to the attached drawings.

Figure 7A:
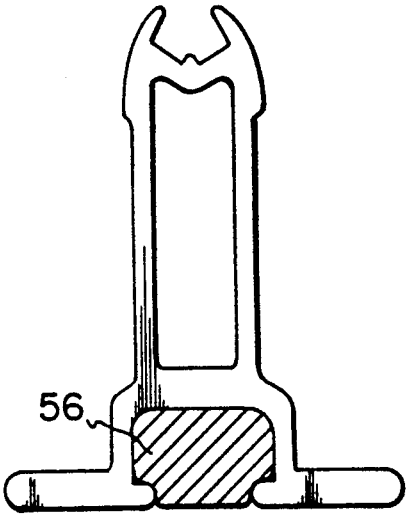
Figure 7B:
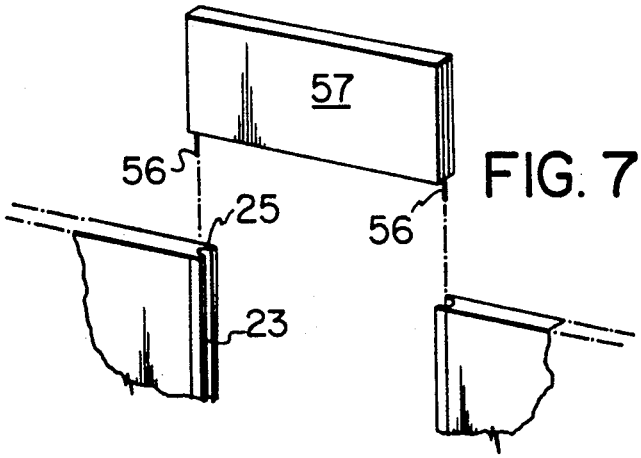

FIG. 7*a* and 7*b* show the arrangement of a top frame.

Figure 8A:
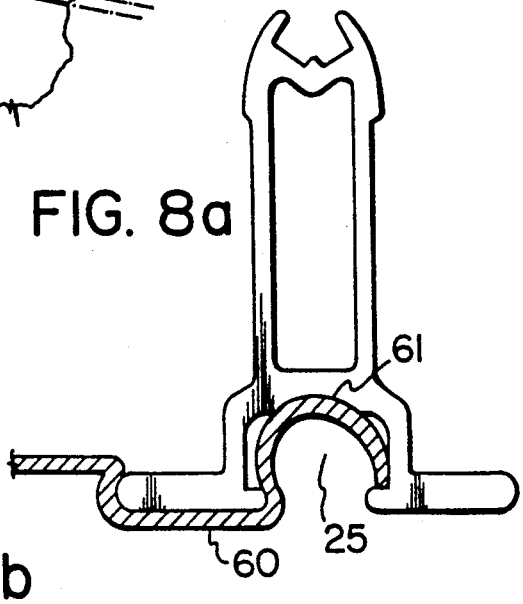
Figure 8B:
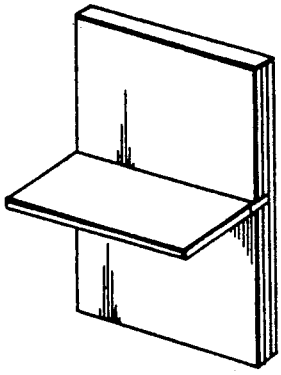

FIG. 8*a* and 8*b* show the arrangement of a bracket in the molder frame member according to the invention.

Figure 9:
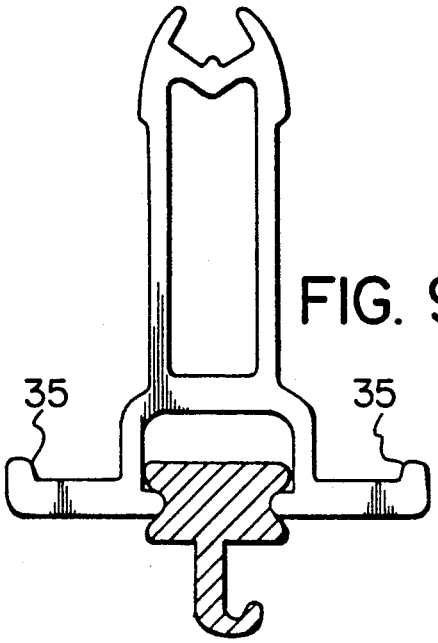

FIG. 9 shows a section through the molded frame member.

Figure 10:
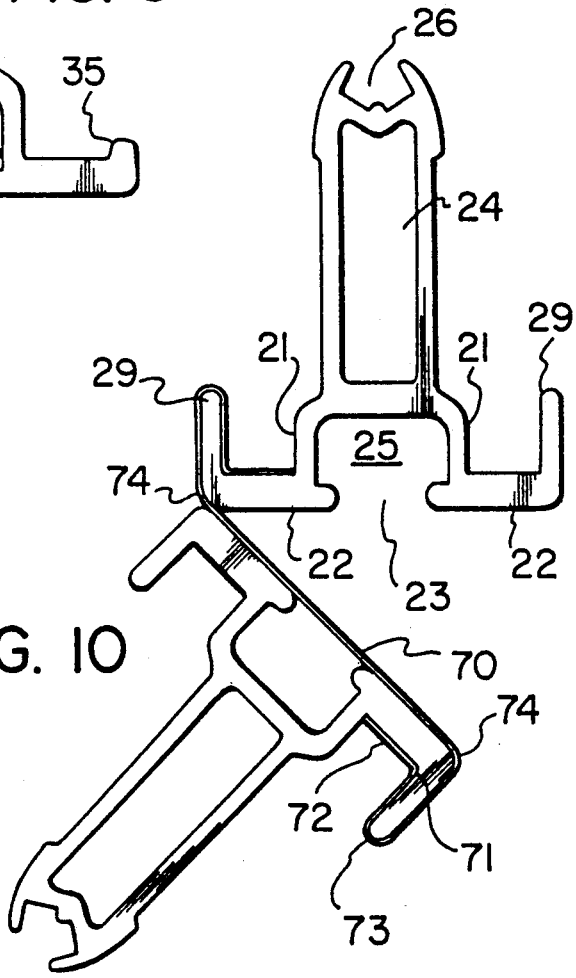

FIG. 10 shows band-shaped hinges between two of the frame members in a second advantageous embodiment according to the invention.

Figure 11:
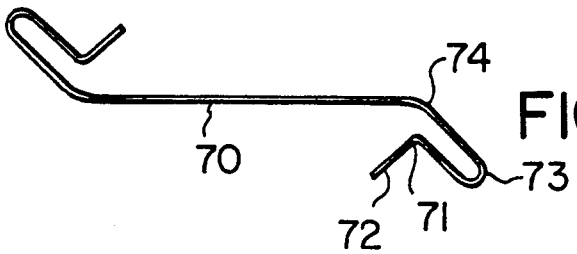

FIG. 11 shows the band-shaped hinge according to FIG. 10 in a dismounted, unstressed condition.

Figure 1:
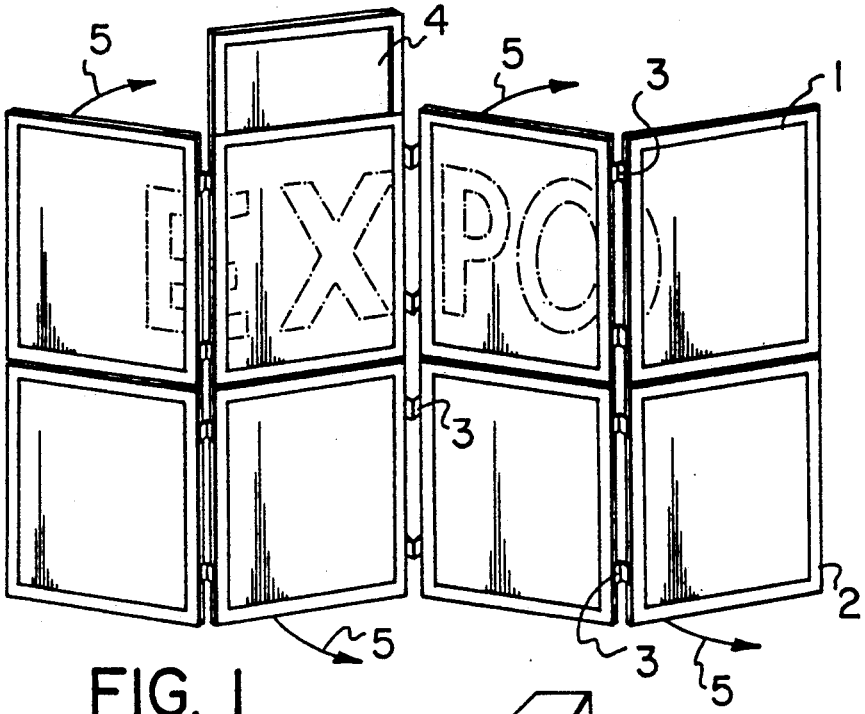
FIG. 1 (PRIOR ART)
FIG. 1 shows a mounted picture stand according to the prior art.

FIG. 1 shows a known picture stand comprising eight frames 1 and 2 arranged in one row with upper frames 1 and one row with lower frames 2. The frames are sidewardly interconnected by hinges 3. On top of one of the frames a releasably attached top frame 4 is shown. When the stand is to be folded, it is first folded in the direction of the arrows 5. Then the snap-action locks, which are located between three of the frames in the upper row and the corresponding three frames in the lower frame, are disconnected and the upper frames are folded downwards against the lower frames.

FIG. 1 illustrates in an obvious way the phenomenon which arises because of the distance between the pictures when one wishes to make two adjacent pictures form a whole and which is disturbing for the beholder.

Figure 2:
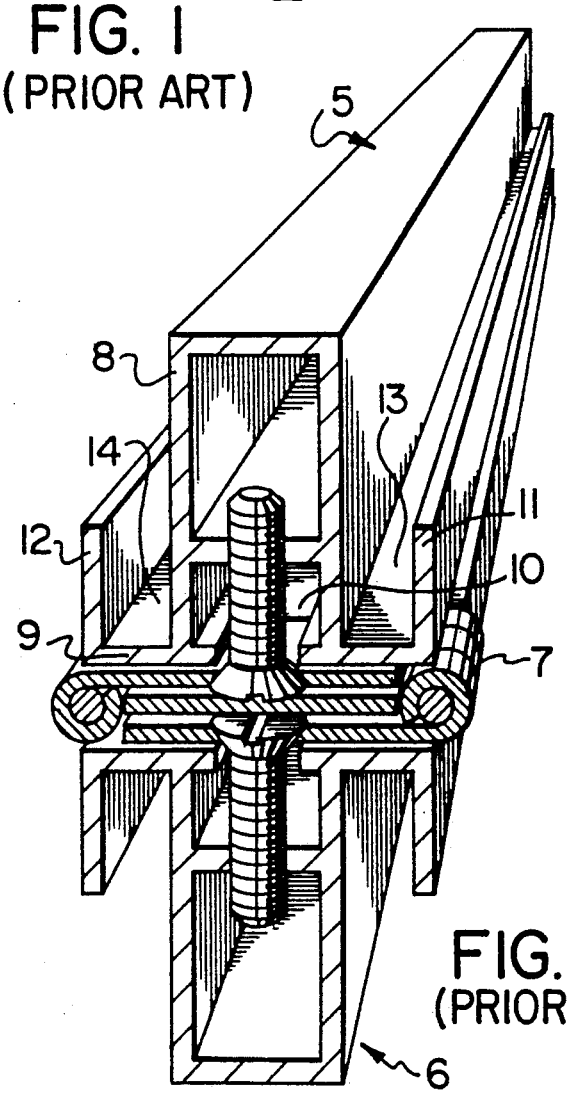
FIG. 2 (PRIOR ART)
FIG. 2 shows a hinge between two molded frame members according to the prior art.

The reason for this problem can more closely be seen in FIG. 2, which shows prior art mouldings 5, 6 and a hinge 7 interconnecting these. The frames shown in FIG. 1 are formed by four such mouldings being arranged in a rectangular form. These mouldings include a first hollow flange 8 and a second flange 9 being pierced by a slot 10. At both ends of the second flange 9 flanges 11, 12 are arranged perpendicularly to the second flange 9 and parallel to the first flange 8. Between these flanges 11, 12 and the hollow flange 8 two grooves 13, 14 are formed whose purpose is to hold the picture.

Figure 3:
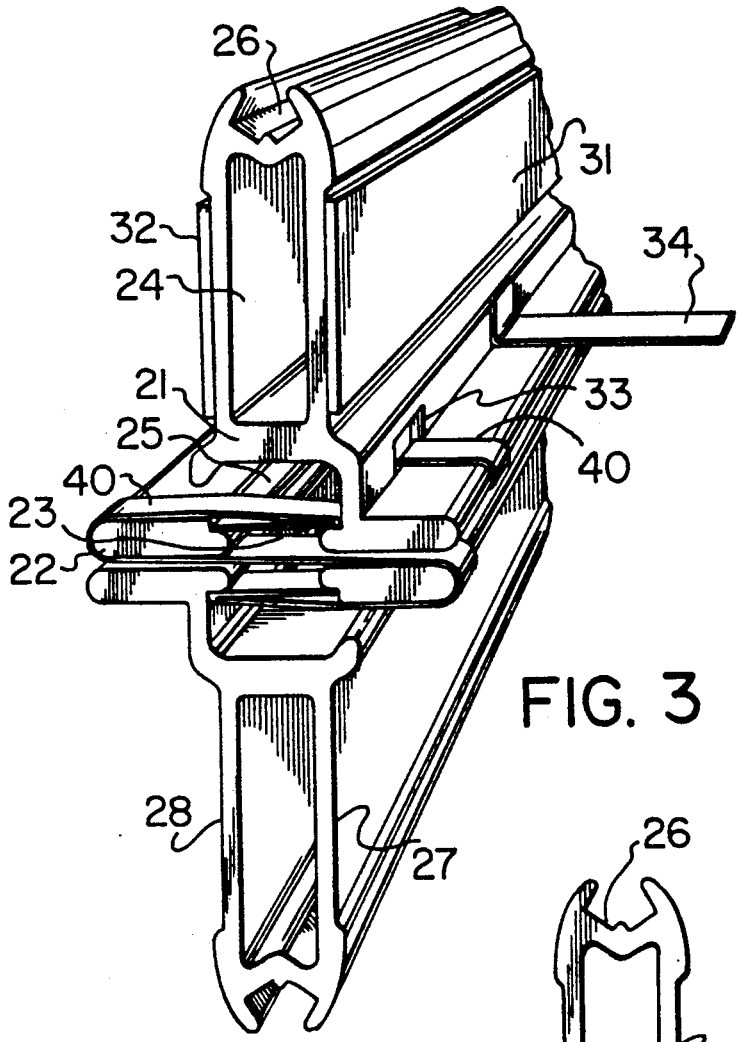
FIG. 3 shows band-shaped hinges between two of the mouldings in a first advantageous embodiment according to the invention.
Figure 4:
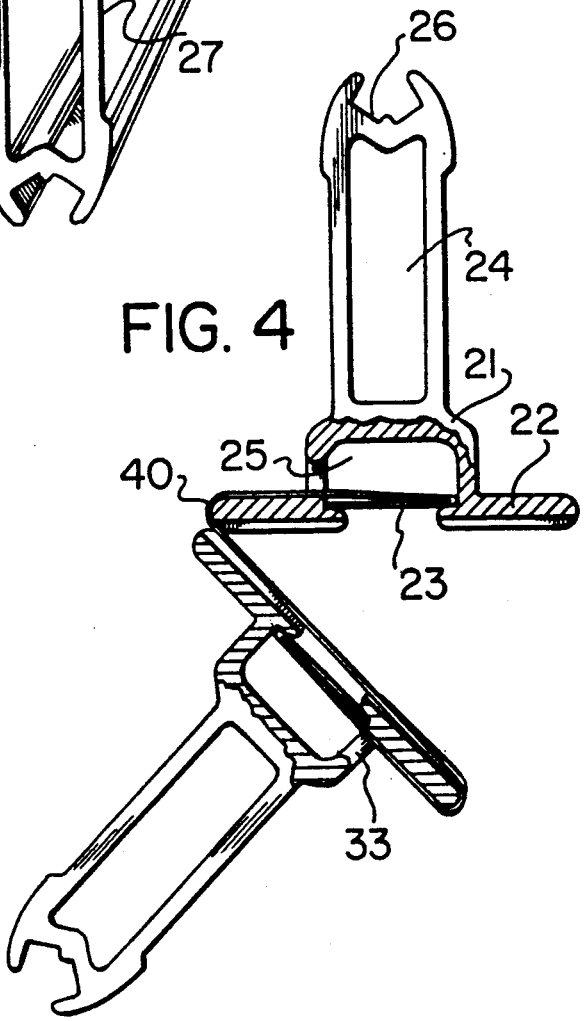
FIG. 4 shows the band-shaped hinge according to FIG. 3 from another angle.
Figure 5:
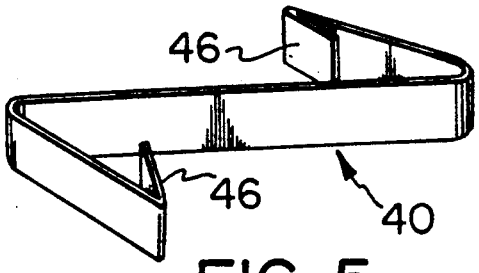
FIG. 5 shows a band to a band-shaped hinge according to FIG. 3.

FIGS. 3 and 4 show a section through two vertical frame members in a first embodiment according to the invention and band-shaped hinges according to the invention which interconnect two frames sidewardly. The two opposing horizontal frame members which are included in each frame are in principle formed in the same manner except that they are not provided with the band-shaped hinges. The frames shown in FIGS. 3 and 4 can for instance be arranged in positions similar to these in FIG. 1. The frame members shown in FIGS. 3 and 4 preferably are made of aluminium or of some suitable kind of plastic material. The moulding has a first flange 21 and a second flange 22 being located in a plane perpendicular to the first flange. The second flange 22 should be as thin as possible since its thickness, together with the widths of the gap between the frames, decides the distance between the pictures. The frame member shown in the figure is formed with a first cavity 24 in the first flange 21. A longitudinal slit 23 extends crosswise through the second flange 22 and is transformed into a longitudinal groove 25 in the first flange 21. An additional groove 26 further is arranged along the second longitudinal narrow side of the frame member which faces the center of the frame. The two opposing longitudinal broader sides of the first flange 21 can be provided with a longitudinal recess 27, 28 each. Attachment means 31, 32 for the pictures can be arranged in these recesses. These attachment means preferably consist of magnetic strips arranged in the recesses 27, 28 in conjunction with thin steel bands attached to the backside of the pictures. The steel bands also can be arranged in the recesses 31, 32, the magnetic strip then being attached to the back sides of the pictures. Other types of attachment means are also possible, for instance so called Velcro-type tapes, double-sides tape and, for a more permanent attachment of pictures, glue. The pictures preferably should b e disconnectably attached in the frames so that the pictures in a simple way can be exchanged and rearranged when the picture stand is in an unfolded condition. It is also conceivable to design the frame members without the recesses 27, 28, thin attachment means then being preferably used. Advantageously a short band 34 is provided on the first flange 21 and attached thereto behind the picture, the other end of the band 34 being allowed to protrude between the picture and the frame. The picture then can be released from the frame in a simple manner by pulling this band 34.

The second flanges 22 can be provided with flanges 35 at their both longitudinal ends, which protrude somewhat, see FIG. 9. These flanges 35 extend a short distance perpendicularly to the second flange 22 towards the center of the frame. These flanges 35 are preferably arranged on one pair opposing frame members of the four frame members of the frame and preferably on the upper and lower, i.e. the horizontal frame members. In this case a magnetic strip or a similar attachment means does not necessarily have to be arranged on the first flange. Due to these protruding flanges 35 the pictures must be bent somewhat when they are attached to the frame. The picture will however be seated more safely in the frame, especially if the picture is not quite level. Magnetic strips may have a tendency to let go when the pictures not are entirely level, since, when a magnetic strip is to be disconnected, it displays the least counter-force when it is pulled away from one end, as compared to when an attempt to free the whole strip simultaneously is made.

The frames are sidewardly interconnected by means of band-shaped hinges. These are anchored in the longitudinal grooves 25 and are inserted into these grooves through oblong, rectangular openings 33.

FIG. 4 the end of a band to a band-shaped hinge is shown. These bands 40 preferably are made of prestretched polyethylene. This kind of polyethylene bands are easily available in the market as tensioning bands for different types of packages. Other types of plastic bands can also be used, for instance polyester bands. The bands are cut to the right size and are folded at both ends, so that two bent-up-parts 46 are obtained. When two frames are to be interconnected, one end of the band is inserted into one of the oblong, preferably rectangular, through-going openings 33 in the first flange 21 of the profiled moulding, extending between the outer side of the flange 21, where this adjoins the flange 22, and the groove 25. The band 40 is inserted from the outside of the flange 21 and pushed so far, that the bent-up part 46 is located within the groove 25. The bent-up part 46, being resilient, then will snap out and is prevented from being displaced out through the opening 33 by the wall of the groove 25. The band 40 can be released from the frame by compressing the folded part of the band end and simultaneously pulling the band 40.

Due to this the frames in a simple way can be added to, or removed from, the picture stand.

Each band-shaped hinge includes two bands 40. The first band runs from the groove 25 in the first flange 21 of a frame member, out through the opening 33 on one side of the first flange 21, around the longitudinal free edge of the second flange 22, in between the first profiled moulding and the second adjacent frame member, around one longitudinal edge of the second flange of the second frame member, through the opening on the side of the first flange of the second frame member which is opposite to one of the sides of the first flange 21, and into the groove in the first flange of the second frame member. The second band runs, in the same way but somewhat displaced in the longitudinal direction of the frame members in relation to the first band, out through the opening on the second side of the first flange 21 of the first frame member and in through the opening 33 on the first side of the first flange of the second frame member. Preferably the band-shaped hinges are arranged pairwise to interconnect two frames.

To make the band-shaped hinges still more narrow, an indentation can be arranged on the second flange of the frame member in which indentation the band runs. This is more closely shown in FIG. 4.

The band-shaped hinge according to the invention thus is considerably more narrow than the prior art hinges shown in FIG. 2. Since the comparatively wide flanges 11 and 12 also can be dispensed with in accordance with the invention, the total distance between the pictures is considerably less than in the prior art picture stand shown in FIG. 1.

Figure 6:
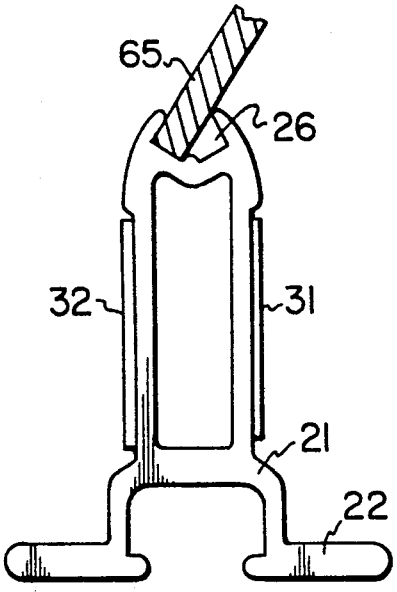
FIG. 6 shows the arrangement of a reflecting screen.

The object of the groove 26 in the longitudinal side of the first flange 21 facing the center of the frame is to hold the reflecting screen 65 of a light box, see FIG. 6. This screen is inserted between two opposing frame members in a frame, preferably between the two vertical frame members. The screen is somewhat wider than the distance between the bottoms of the two opposing grooves 26, and it will therefore become somewhat arched when inserted. More specifically, the width of the screen should be such that it, in a not inserted condition, could be inserted into the frame like an ordinary picture and be held by means of the magnetic strips which preferably are arranged. It is also conceivable to attach other devices in the grooves 26, for instance internal brackets, nets for the suspension of different objects etc.

The FIGS. *7a* and *7b* show pins for the attachment of a top frame 57 on top of an upper frame or above and between two frames arranged at a distance from each other.

FIGS. 8 and 8*a* show how shelf brackets 60 can be arranged in a vertical frame members. To allow this, openings 61 have been provided in the bottom of the groove 25.

FIG. 9 also shows that different kinds of hooks for curtains or similar can be arranged in a frame member being included in for instance a top frame.

In FIG. 10 a second preferred embodiment according to the invention is shown. In this embodiment the longitudinal second flanges 22 of the profiled moulding have been provided with a longitudinal edge or flange 29 in conjunction to its free, outer edge. This edge 29 is arranged at an angle to said second flange 22 and in the same direction as the first flange 21. The angle between the flange 22 and the edge 29 is preferably a right angle. Together with the flanges 21 these edges 29 define a space with opposing walls wherein the ends of a band-shaped hinge can be received and restrained. These longitudinal edges 29 furthermore also can be used to hold a picture in the frame member in the same way as the flanges 35 shown in FIG. 9. A suitable embodiment of a band-shaped hinge for use together with the profiled mouldings according to FIG. 10 is shown in an unstressed, dismounted condition in FIG. 11. This band-shaped hinge 70 is made of a piece of a band of thin spring steel. The band is at each end provided with a first bending 71 that defines a first band part 72 in conjunction with the respective end of the band. This first band part 72 has a length corresponding to or somewhat exceeding the distance between the flange 22 and the edge 29 and is bent in an angle to the adjacent part of the piece of the band corresponding to the angle between the edge 29 and the flange 22, which normally is a right angle. The piece of band is further provided with a second bending 73 at each end at a distance from the first bending 71 corresponding to the height of the longitudinal edge 29 and being oriented in the opposite direction to the first bending 71, this second bending 72 being designed in a way that the part of the piece of band being located adjacent to the bending 73 substantially follows the cross-section contour of the edge 29. In the normal case the bending is made to 180°. The bendings made at each end of the band piece in this way are oriented in the same way, clock-wise or counter-clock-wise, relatively the center of the piece of band, i.e., they project to opposite sides relatively to a plane coinciding with the central, planar part of the piece of band. The band-shaped hinge can advantageously be provided with an additional, third small bending 74 at each end of the piece of the band at a distance from the second bending 73 corresponding to the height of the outer side of the longitudinal edge 29. When the band-shaped hinge is mounted, the band part 72 is pressed down into the space between the flange 21 and the edge 29 to the position which is shown in FIG. 10. Since the length of the band part 72 corresponds to, or somewhat exceeds, the distance between the flange 21 and the edge 29 this part 72 will be effectively locked into position in this space. The third bending 74 serves as an indication for the bending of the hinge around the corner between the flange 22 and the edge 29 on the respective profiled moulding and co-operates to hold the band-shaped hinge in position. Since the band-shaped hinge 70 in this embodiment is locked and effectively held in position in addition to being made of spring-steel, it may be sufficient to only use two separate hinges per side. In this case the edges 29 also can be used to hold pictures and similar and an extra safeguard is obtained for the band-shaped hinge since a picture inserted between the flange 21 and the edge 29 further will prevent the band part 72 from coming loose.

When the band-shaped hinge 70 is to be dismounted, the band part 72 simply is lifted out from the space between the edge 29 and the flange 21 by means of a narrow knife or a screw-driver.

This second preferred embodiment has the same advantages as the above described first embodiment and can of course be varied in the same manner as shown in the FIGS. 6–9 and which has been described in connection with this first embodiment.

I claim:

1. An assembly for mounting and displaying suitably dimensioned planar elements, said assembly including a plurality of frame members which are formed by profiled mouldings, each said molded frame member being defined by first and second longitudinal flanges, said first flange being arranged at right angles to said second flange in a T-shaped configuration, said first flange having two opposed wide flat surfaces and two opposed relatively narrower surfaces, said relatively wide flat surfaces and said relatively narrower surfaces each being substantially perpendicular to said second flange, wherein said second flange is located adjacent said relatively narrower surfaces of said first flange, each said frame being constructed to receive a planar element between opposed pairs of said frame members, wherein at least two said frame members in a said assembly are located adjacent each other with the said second flange of a frame member of one being in substantially face to face relationship with the said second flange of a frame member of the other, and wherein said assembly further includes band-shaped hinges between said face to face second flanges to releasably and hingedly secure together said adjacent frame members, said band-shaped hinges each having a pair of ends with resilient bent up portions adapted to engage a said frame member, and wherein frame assembly has up of four said frame members arranged as a rectangle with the outermost surface of said second flanges of each of said up to four frame members defining the perimeter of said rectangle, the innermost surface of said second flanges of each of said up to four frame members defining an engaging surface for a suitably dimensioned said planar element, and the flat surfaces of the first flanges of said up to four frame members forming a surface against which a planar element may be mounted.

2. An assembly according to claim 1, wherein when two adjacent frame members are to be connected, said second flange in each of said frame members faces said second flange of an adjacent second frame member, such that each one of the bands is inserted into one of the said rectangular openings in a frame member so far into the said space that the bent-up part snaps out and prevents the band from being pulled out, said band lying around the second flange of each adjacent frame member, then in between the second flanges of the frame members and around the second flange which is opposed, and that the second bent-up part of the band is inserted into a corresponding opening in the adjacent frame member.

3. An assembly according to claim 1, wherein the frame members have recesses in the longitudinal wide surfaces of said first flanges for receiving attachment means for the said planar elements.

4. An assembly according to claim 1, wherein said frame members are provided with a longitudinal slit extending through said second flange into a space defined between the said relatively narrower surfaces of said first flange, and wherein said frame members are further provided with narrow openings that are substantially rectangular extending between said space and said flat surfaces of said first flange, where said first flange adjoins said second flange.

5. An assembly according to claim 4, wherein adjacent frame members are releasably secured together by means of at least two band-shaped hinges, each including at least two bands.

6. An assembly according to claim 4, wherein a groove is provided in each frame member on the longitudinal narrow surface of said first flange remote from said second flange.

7. An assembly according to claim 1, wherein said longitudinal second flanges of said frame members are provided with third flanges in the vicinity of the outer edge of said second flanges, said third flange being arranged at an angle to said second flange substantially perpendicularly thereto, and oriented in the same direction as said first flange, said frame members being releasably attached to each other by means of band-shaped hinges attached to said longitudinal edges.

8. An assembly according to claim 7, wherein the band-shaped hinges are in the form of band-sections, preferably made of thin spring-steel, in that said band-section at each end is provided with a first bending, which, together with the end of the band-section, defines a first band part preferably arranged at an angle corresponding to the angle between said longitudinal third flange and said second flange, and having a length corresponding to, or slightly exceeding, the distance between said third longitudinal flange and said first flange, that said band-section is provided with a second bending at a distance from said first bending that substantially corresponds to the height of the third longitudinal flange, the bending having been made in a way that the band-section substantially follows the contour of the cross-section of the third longitudinal flange, said second bending preferably being 180°, and that the bent parts located at each end of the band-section project in opposing directions relatively the intermediate, flat, central main part of the band-section.

9. An assembly according to claim 8, wherein the band-section is provided with a third, slight bending at each end and at a distance from said second bending corresponding to the height of the outer side of said third flange.

10. An assembly according to claim 9, wherein said second flange of a first one of said frame members faces said second flange of an adjacent, second frame member when said two frame members are to be interconnected, said first band part being pressed into the space between said first flange and said third flange of the respective frame member.

11. An assembly according to claim 8, wherein said second flange of a first one of said frame members faces said second flange of an adjacent, second frame member when said two frame members are to be interconnected, said first band part being pressed into the space between said first flange and said third flange of the respective frame member.

* * * * *

UNITED STATES PATENT AND TRADEMARK OFFICE

CERTIFICATE OF CORRECTION

PATENT NO. : 5,016,374

DATED : May 21, 1991

INVENTOR(S) : Carl-Otto ENGSTROM

It is certified that error appears in the above-identified patent and that said Letters Patent is hereby corrected as shown below:

Col. 7, claim 1, line 24, after "up" change "of" to --to--.

Signed and Sealed this

Twenty-second Day of September, 1992

*Attest:*

DOUGLAS B. COMER

*Attesting Officer*

*Acting Commissioner of Patents and Trademarks*